United States Patent [19]

Kruse

[11] 3,973,602

[45] Aug. 10, 1976

[54] FUNNEL WITH SIGNAL

[76] Inventor: Frederick W. Kruse, Box 917 - R.D. No. 1, Oakdale, Pa. 15071

[22] Filed: June 18, 1974

[21] Appl. No.: 480,985

Related U.S. Application Data

[63] Continuation-in-part of Ser. No. 2,581, Jan. 13, 1970, abandoned.

[52] U.S. Cl. ..... 141/95; 141/297; 141/309

[51] Int. Cl.[2] ..... B67C 11/00

[58] Field of Search ..... 141/94, 95, 96, 290, 141/297, 300, 308, 309, 360, 331, 340, 343, 379; 220/86 R

[56] References Cited

UNITED STATES PATENTS

| | | | |
|---|---|---|---|
| 129,783 | 7/1872 | Brown | 141/309 |
| 918,814 | 4/1909 | Barney | 141/300 |
| 1,517,644 | 12/1924 | Kruger | 141/309 |
| 1,564,489 | 12/1925 | Neil | 141/309 |
| 1,580,737 | 4/1926 | Kelletson | 141/309 |
| 1,672,983 | 6/1928 | Maple | 141/308 |
| 1,844,233 | 2/1932 | Whitney | 141/309 |
| 2,871,895 | 2/1959 | Rektorys | 141/290 |

FOREIGN PATENTS OR APPLICATIONS

| | | | |
|---|---|---|---|
| 564,228 | 10/1923 | France | 141/300 |

*Primary Examiner*—Houston S. Bell, Jr.
*Attorney, Agent, or Firm*—A. Yates Dowell, Jr.

[57] ABSTRACT

A funnel apparatus for use in filling a container without overflowing and which sealingly engages the filling opening of an imperforate container when the container is being filled with liquid and such apparatus has a vent which terminates below the normal liquid level in the upper portion of the apparatus when in use and through which air displaced from the container being filled must pass. The displaced air from the container creates a signal in the form of bubbles which pass through the liquid within the apparatus until the liquid level in the container closes the vent at which time the bubbles stop and the user is apprised of the fact that the container is substantially full and that pouring into the apparatus should stop. Thereafter the liquid remaining in the funnel apparatus can drain into the container without overflowing.

7 Claims, 7 Drawing Figures

FUNNEL WITH SIGNAL

CROSS-REFERENCE TO RELATED APPLICATIONS

This is a continuation-in-part of application Ser. No. 2,581 filed Jan. 13, 1970 and now abandoned.

BACKGROUND OF THE INVENTION

In filling containers by means of a funnel, it is often difficult to determine when to stop pouring without causing overflowing. This is particularly true in cases where the container being filled has opaque walls, such as a gasoline tank or lantern. In the past, funnels have been provided having gaskets for sealing the filling opening of containers and with vents which permit displaced air in the container to escape to atmosphere until the liquid level closes the vent. Normally, these prior art devices have not included signalling apparatus or have included an audible signal that required substantial compression of the displaced air before the signal could be heard.

Other prior art devices have used a stream of bubbles as a signal; however, these devices have been for use with containers which were open to atmosphere. Some examples of the prior art are the U.S. patents to Balden No. 657,080; Barney No. 918,814; Mapel No. 1,672,983; Rektorys No. 2,871,895; British Pat. No. 7,959 of 1896 to Robinson; and French Pat. No. 564,228 of 1923 to Hutchison.

SUMMARY OF THE INVENTION

In accordance with the present invention, a funnel is provided having a vent tube or opening so that air displaced from a container as the container is being filled with liquid must pass through the opening or vent tube and up through the liquid within the funnel, thereby creating bubbles which may be heard and visually observed. In this respect, the neck of the funnel is provided with a seal which engages the periphery of the filling opening of the container so that the displaced air must pass through the vent tube or opening in the neck of the funnel rather than through an opening into which a funnel is loosely fitted. When the liquid level within the container closes the lower end of the vent tube, the bubbles stop, thereby apprising the user that the container is almost filled. Thereafter, the funnel may be moved to break the seal with the opening in the container; whereupon the remainder of the liquid within the funnel drains into the container without causing overflowing.

Further, in accordance with the invention, a funnel of the type described may be incorporated into a gasoline tank or the like as a permanent fixture. In this case, the absence of bubbles will indicate that the tank is almost full and signal the user to stop pouring; however, instead of pulling the funnel out of an opening for the tank, a cap is provided for the funnel which is closed when the bubbles stop with an amount of liquid remaining in the funnel. Thereafter, as the gasoline is consumed from the tank, the liquid within the funnel drains down into the tank.

Finally, in another illustrative embodiment of the invention, the funnel is provided with an elongated generally cylindrical neck which slides within a resilient seal or the like whereby the bottom of the vent tube, or a hole in the funnel neck, can be adjusted upwardly or downwardly to thereby vary the liquid level attained in the container before the bubbles stop.

Description of the Preferred Embodiments

Figure 1A:
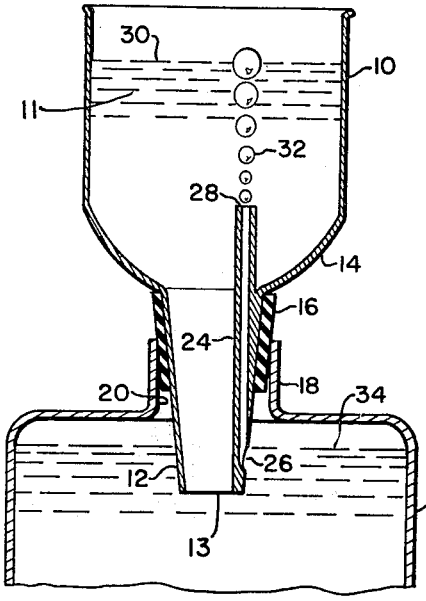
FIGS. 1A and 1B are cross-sectional and broken-away perspective views, respectively, of one embodiment of the invention.
Figure 1B:
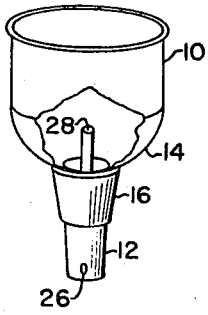

With reference to the drawing, and particularly to FIGS. 1A and 1B, the funnel shown includes an upper hopper or bowl 10 into which liquid 11, such as gasoline, kerosene, or other volatile petroleum distillate, is poured. A lower neck or nose-tube 12 having a discharge opening 13 at the lower end is integrally connected to the hopper 10 by an intermediate tapered portion 14. Surrounding the upper portion of the neck 12 is an annular seal 16 of resilient material, such as rubber or neoprene, which fits into the neck 18 or filling opening 20 for a container 22 which is to be filled.

The funnel itself is preferably formed from synthetic organic polymeric thermoplastic material of the type which can be injection molded, such as acrylics, cellulosics, chlorotrifluoroethylene, polyethylene, and the like. Extending along the inner periphery of the neck 12 and formed integrally with the remainder of the funnel is a hollow vent tube 24 having a lower end terminating in an opening 26 extending through the wall of the neck 12 in spaced relationship to the discharge opening 13 and an upper end 28 which normally is below the liquid level 30 in the hopper 10 of the funnel when in use. Preferably the opening 26 is generally elliptical in shape with the major axis disposed substantially vertically of the axis of the neck 12. The hopper 10 is of a size to receive a known volume of liquid and the neck extends into the container a distance such that the space above the vent opening 26 is of greater volume than the volume of the funnel.

In the use of this embodiment of the invention, the funnel is inserted into the opening 20 until a snug airtight fit is attained between the opening and the seal 16. As liquid is poured into the funnel, such liquid flows through the discharge opening 13 by gravity into the container 22 controlled by a head pressure extending upwardly from the discharge opening to the upper level of the liquid within the hopper 10. The inflow of liquid compresses the air within the container and forces such air through the opening 26 into the vent tube 24 because the head pressure above the vent tube is less than the head pressure of the neck 12. The air escaping through the vent tube 24 is discharged into the liquid within the hopper 10 and produces bubbles 32 in such liquid which can be observed by the user and the bubbling sound can be heard.

When the liquid level within the container 22 rises to the level indicated by the reference numeral 34 in FIG. 1A, the lower vent opening 26 is closed by the liquid within the container and no further air can escape. Hence, the bubbles stop; and when this is observed by the user it is known that the liquid level is near the top of the container. When air can no longer escape from the container, the air remaining in the upper portion of the container is compressed by the liquid and stops any additional ingress of liquid. Thereafter the hopper 10 is filled with liquid since such hopper contains a predetermined quantity of liquid. If, now, the funnel is unseated from the opening 20, the air remaining within the container can escape and the contents of the funnel drain into the container 22.

Due to the elliptical configuration of the lower vent opening 26, when the liquid level within the container passes the center of the opening, the character of the bubbles changes. As liquid continues to be introduced into the container, the size of the bubbles is reduced and the tonal quality of the bubbling sound changes pitch. Both the size and sound of the bubbles forewarns the user that the container is almost filled.

Figure 2:
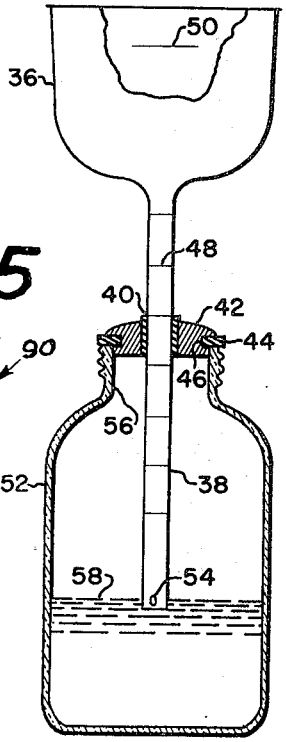
FIG. 2 is an elevational view, partly in section, of an embodiment of the invention wherein the funnel neck may be adjusted vertically relative to the container.

With reference now to FIG. 2, another embodiment of the invention is shown which is similar to that shown in FIGs. 1A and 1B in that it comprises an upper hopper 36 communicating with a neck 38. In this case, however, the neck 38 is of constant diameter and slidable within an annular seal 40 carried within a cap 42 having an annular washer-type seal 44 fitted into a slot 46 extending around its periphery. The cap 42 may be formed from plastic or other similar material while the seals 40 and 44 are formed from rubber, neoprene or some other similar resilient material. The main requirement of the seal 40 is that it permit sliding movement of the neck 38 while at the same time preventing the escape of air.

The neck 38 is provided with one or more calibrations 48; and, similarly the hopper 36 is provided with a single calibration 50. As will be understood, sliding the neck 38 upwardly or downwardly within the seal 40 will determine the height of the liquid level reached within a container 52 before bubbles, passing upwardly from a vent port 54, case within the hopper portion 36. The container 52 may, for example, be a baby bottle having an upper opening 56 against which the seal 44 butts and may be held by a slight amount of finger pressure.

When bubbles are no longer observed in the hopper 6, it is known that the liquid level has reached that indicated by the reference numeral 58 in FIG. 2. Continued pouring of liquid into the hopper 36 brings the liquid level up to calibration 50. Then, when the cap 42 is pulled upwardly and the seal between the opening 56 and seal 44 is broken, the remainder of the contents within the funnel drain down into the container 52, the total amount within the container being that marked on the calibration which is aligned with the top of the seal 0.

Figure 3:
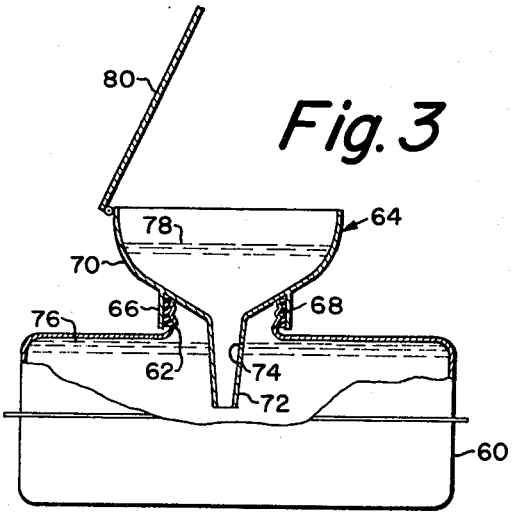
FIG. 3 is a vertical section illustrating another embodiment of the invention as applied to a gasoline tank and wherein the funnel becomes a permanent part of the tank.

In FIG. 3 another embodiment of the invention is shown for filling a gasoline tank, such as a tank used on gasoline lawn mowers or other internal combustion engine. In FIG. 3 the tank is indicated by the reference numeral 60 and has a conventional threaded opening 62 which normally receives a threaded gas cap. In this case, however, the opening 62 is fitted with a funnel 64 having a downwardly depending skirt 66 provided with a seal 68 which engages the threads on the opening 62. If desired or necessary, a circular clamp may be provided around the skirt 66 to hold the funnel in place and prevent any possible escape of air through the seal.

The funnel 64 again includes an upper hopper 70 and a lower neck 72 provided with a vent port 74. In this case, gasoline or other fuel is poured into the hopper 70 and air escapes as bubbles through the vent port 74. When it is observed that the bubbles stop, it is known that the liquid level witin the tank 60 is that indicated by the reference numeral 76 (i.e., the tank is full). At this time, however, there will be a certain residual amount of gasoline or other liquid within the hopper 70 as indicated by the liquid level 78. In this case, instead of pulling the funnel out of the tank 60, the funnel remains in place; and a hinged lid 80, provided with a vent, is rotated downwardly and clamped to the funnel 70. As the gasoline within the tank 60 is used, the liquid level 76 falls while air escapes upwardly through the vent port 74 and the remaining liquid within the funnel drains down into the tank 60. This arrangement, of course, prevents spilling of gasoline which is so prevalent in attempting to fill small gasoline tanks.

Figure 4:
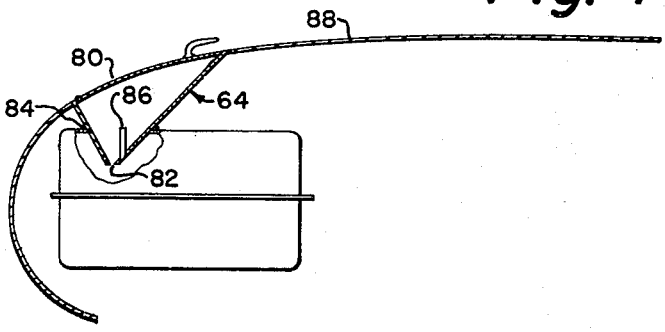
FIG. 4 is a vertical section illustrating still another embodiment of the invention similar to that of FIG. 3 as applied to a gasoline tank.

In FIG. 4 another embodiment of the invention is shown which is similar to that shown in FIG. 3. Accordingly, elements in FIG. 4 which correspond to those of FIG. 3 are identified by like reference numerals. In this case, however, the funnel 64 has no neck portion, but only a discharge opening 82 at the lowwer end of a frusto-conical wall 84. A vent tube 86 extends upwardly through the lower portion of the conical wall 84 in spaced relationship to the discharge opening 82 and serves the same purpose as the vent port 74 of FIG. 3. That is, it permits air as bubbles to escape upwardly through the liquid within the funnel 64 until the tank 60 is filled. The hinged lid 80 in this case is curved to fit into the streamlined contour 38 of a vehicle skin or engine cowl, for example.

Figure 5:
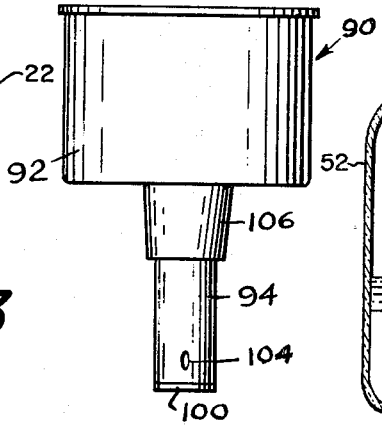
FIG. 5 is a side elevation of a further embodiment of the invention.
Figure 6:
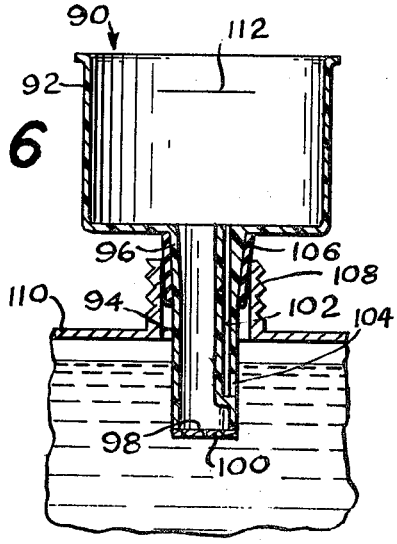
FIG. 6 is a vertical section of the apparatus of FIG. 5 in use.

With reference to FIGS. 5 and 6, a funnel 90 is provided having a hopper 92 connected to a neck 94 by an intermediate tapered portion 96. The lower end of the neck has a discharge opening 98 which preferably has a fine mesh screen 100 located across the discharge opening to prevent the introduction of solid foreign matter into the container. A vent tube 102 is formed integrally with the funnel and extends from a position adjacent the bottom of the hopper 92 downwardly through the intermediate portion 96 and into the neck 94 where it terminates above the discharge opening 98. A vent opening 104 extends through the wall of the neck 94 and provides communication between the vent tube 102 and the exterior of the neck.

An annular sealing band 106 of rubber or other resilient material is mounted on the intermediate tapered portion 96 and is adapted to seal the filling opening of the neck 108 of an imperforate container 110 such as the fuel tank of a gasoline stove or lantern. A calibration 112 may be provided near the upper end of the hopper 92 if desired to indicate the level to which the liquid within the funnel should be filled after the flow of liquid into the container 110 has ceased. It is noted that the neck 94 of the funnel extends into the container 110 a distance sufficient that when the liquid within the container closes the vent opening 104, enough space remains within the container to accommodate the liquid within the funnel after the seal between the bank 106 and the neck 108 of the container is broken.

When the liquid being introduced into the container is a volatile hydrocarbon, such as gasoline, kerosene or the like, a liquid lock occasionally may form in the neck of the funnel, particularly at a temperature of approximately 40° F or below. When this condition occurs, the volatile liquid within the container increases the air pressure therein and forces air through the vent opening 104 and vent tube 102 into the liquid within the hopper to break the lock so that the liquid from the hopper again flows into the container.

In the operation of this modification, the funnel 90 is inserted in the neck 108 of the container 110 so that the sealing band 106 forms an airtight connection and prevents the ingress or egress of air into or from the container. When the liquid is poured into the hopper, such liquid flows downwardly through the tapered portion 96 and the neck 94 into the container. Initially the liquid is poured into the hopper at a faster rate than the flow of liquid through the neck so that a pool of liquid is disposed within the hopper. As the liquid flows into the container, the liquid level within the container rises and compresses the air therein so that such air is forced through the vent opening 104 and upwardly through the vent tube 102. At the base of the hopper, the air is discharged into the body of liquid in the hopper in the form of bubbles which can be seen and heard by the person who is introducing liquid into the hopper.

When the liquid level within the container rises to a point substantially midway of the vent opening 104, the character of the bubbles passing upwardly through the liquid within the hopper changes since the bubbles become smaller and the sound assumes a higher pitch. The change of character of the bubbles forewarns the operator that the flow of liquid through the neck 104 soon will case. As the liquid level within the container rises to a level where it closes the vent opening 104, air no longer is discharged through the vent tube and therefore the bubbles cease and no additional liquid flows into the container since the air remaining within the container is compressed and prevents the liquid within the hopper from flowing by gravity into the container. At this time the person filling the container may continue the introduction of liquid into the hopper until the liquid level therein reaches approximately the calibration 112 after which the introduction of liquid into the hopper is stopped. Thereafter the seal between the band 106 and the neck 108 of the container is broken and the fluid remaining within the hopper drains into the container since the air remaining within the container escapes through the neck 108.

I claim:

1. In a system for filling a hollow container with liquid without overflowing, said container having imperforate walls with a generally circular filling opening and being of a size to receive a first volume of liquid; the improvement comprising a funnel having a hopper with an open top, said hopper being of a size to receive a second volume of liquid which is less than the first volume of liquid received by the container, wall structure defining a generally cylindrical hollow neck having one end communicating with the interior of said hopper, the other end of said neck having a discharge opening for discharging liquid from said hopper, an annular seal mounted on the exterior of said neck and engageable with the filling opening of the container to form an airtight seal therewith, said wall structure having a vent opening spaced from said discharge opening and providing communication between the interior and exterior of said neck, said neck being of a length to extend into the container a distance such that the container space above the vent opening of the neck has a volume greater than said second volume of liquid within said hopper, whereby when said funnel is placed in the filling opening of the container with said annular seal in sealing engagement therewith and liquid is poured into said hopper, such liquid flows by gravity through said neck into the container and forces air in the container to be discharged through said vent opening in the neck of the funnel and rise as a stream of bubbles through the liquid in said hopper which may be observed and heard by the person pouring liquid into the hopper until the liquid within the container closes said vent opening to stop the flow of liquid into the container and thereafter when the engagement between the filling opening and said seal is interrupted said second volume of liquid drains from said hopper into the container without overflowing.

2. The structure of claim 1 including a vent tube communicating with said vent opening and extending upwardly through said hollow neck, the upper end of said vent tube terminating below the normal liquid level of said hopper.

3. The structure of claim 2 in which the upper end of said vent tube terminates in the lower portion of said hopper.

4. The structure of claim 2 in which the upper end of said vent tube terminates adjacent to said one end of said neck.

5. The structure of claim 1 in which said vent opening is generally elliptically shaped with the major axis disposed generally parallel to the axis of said neck.

6. The structure of claim 1 including a tapered intermediate portion connecting said hopper and said neck.

7. The structure of claim 1 including screen means disposed across said discharge opening.

* * * * *